US006760958B2

(12) United States Patent
Tejima

(10) Patent No.: US 6,760,958 B2
(45) Date of Patent: Jul. 13, 2004

(54) STRAP BUCKLE

(75) Inventor: Masaru Tejima, Kashiwa (JP)

(73) Assignee: Teplas Co., Ltd., Chiba (JP)

( * ) Notice: Subject to any disclaimer, the term of this patent is extended or adjusted under 35 U.S.C. 154(b) by 0 days.

(21) Appl. No.: 10/342,086

(22) Filed: Jan. 14, 2003

(65) Prior Publication Data

US 2003/0135966 A1 Jul. 24, 2003

(30) Foreign Application Priority Data

Jan. 18, 2002 (JP) ..... 2002-009312
May 28, 2002 (JP) ..... 2002-153199

(51) Int. Cl.[7] ..... A44B 11/26
(52) U.S. Cl. ..... 24/616
(58) Field of Search ..... 24/614, 615, 616, 24/618, 626, 625; D11/216, 218

(56) References Cited

U.S. PATENT DOCUMENTS 804,871 A * 11/1905 Murray ..... 2/329
821,216 A * 5/1906 Castera, Jr. ..... 267/71
1,141,575 A * 6/1915 Naylor ..... 24/616
1,477,597 A * 12/1923 Schneider ..... 24/616
2,805,499 A * 9/1957 Nutter, Jr. et al. ..... 40/300
3,167,835 A * 2/1965 Bengtsson ..... 24/625
4,639,982 A * 2/1987 Kasai ..... 24/616
4,688,337 A * 8/1987 Dillner et al. ..... 24/616
4,970,762 A * 11/1990 Oreck et al. ..... 24/625
5,203,057 A * 4/1993 Runnels ..... 24/574.1
5,222,279 A * 6/1993 Frano et al. ..... 24/625
5,465,472 A * 11/1995 Matoba ..... 24/625
6,076,237 A * 6/2000 Goorhouse ..... 24/200
6,591,461 B2 * 7/2003 Salentine et al. ..... 24/115 F
6,615,460 B1 * 9/2003 Baumgarten ..... 24/615

FOREIGN PATENT DOCUMENTS

FR 2598601 A * 11/1987 ..... A44B/13/00

* cited by examiner

*Primary Examiner*—James R. Brittain
(74) *Attorney, Agent, or Firm*—Jordan and Hamburg LLP

(57) ABSTRACT

To supply a strap buckle that can be formed in an inexpensive mold, that has a miniaturized and simplified structure and thus is expensive, and to which a belt, etc., formed into a loop can be attached easily, such that male part 1 is composed of push-through ring 10 for belt attachment and insertion part 7; aforementioned insertion part 7 is composed of slit 9 that bifurcates it and two catching pieces 6, 6 that are folded back and outwardly from the ends of thereof; female part 2 is shaped approximately like a rectangular cylinder; male part insertion hole 3 is provided at one end in the longitudinal direction and loop cord mounting hole 12 is provided at the other end; and catch-receiving side hole 4 is provided on its side 8 and catch-receiving projection 5 of male part catching piece 6 is provided on both sides, on the insertion hole 3 side.

1 Claim, 16 Drawing Sheets

STRAP BUCKLE

BACKGROUND OF THE INVENTION

The present invention relates to a strap buckle and further to a strap buckle structure such that the mold structure is simplified and a belt, cord, etc., can be attached easily to the strap buckle.

Strap buckles generally consist of a male part 1 and a female part 2. Female part 2 of a conventional strap buckle is provided with a release lever 13, as shown in FIG. 16, for example, and it is formed by using a (split-type) slide core that is bifurcated both longitudinally and transversely, to form a catch-receiving side hole 4 on the side, which is used to catch a catching piece 6 of male part 1.

Also, in conventional strap buckles, the push-through ring 10 for the belt, cord, etc., is formed into a closed ring. To attach the belt, cord, etc., the strap buckle is provided in advance and the free end of the belt or cord is inserted into an annular push-through ring 10, after which it is either sewn or tied. Or, when a belt or cord is not used, another coupling part is used when attaching an annular material with an insertion hole.

As a result, there are the following drawbacks: It is impossible to miniaturize a conventional strap buckle because of the presence of release lever 13, and the aforementioned (split-type) slide core is used during molding because of the structure, so the mold yield is limited, making it difficult to obtain many pieces, thereby preventing the inexpensive production of molds. They also have the following problems that must be solved: When a belt, cord, etc., is attached to a strap buckle, if the belt has been pre-sewn into a loop or if the cord has been pre-tied into a loop, it cannot be attached directly to the buckle, so it is attached by a means such as that aforementioned. Therefore, the workability is extremely poor, and when an annular material with an insertion hole is attached instead of a belt or cord, another coupling part is required.

SUMMARY OF THE INVENTION

Therefore, to eliminate the drawbacks and problems of the aforementioned conventional examples, the present invention has the purpose of supplying an inexpensive strap buckle by simplifying the structure of the female part to enable molding with an inexpensive mold, without using a (split-type) slide core, and it has the purpose of supplying a strap buckle such that the addition of a contrivance to the structure of the male part allows a belt, cord, etc., to be attached simply to the strap buckle, and it enables the attachment of another annular material with an insertion hole. To solve the problems aforementioned, the strap buckle of the present invention will be explained next with reference to the symbols in the drawings showing the embodiments.

DESCRIPTION OF THE PREFERRED EMBODIMENTS

Figure 1:
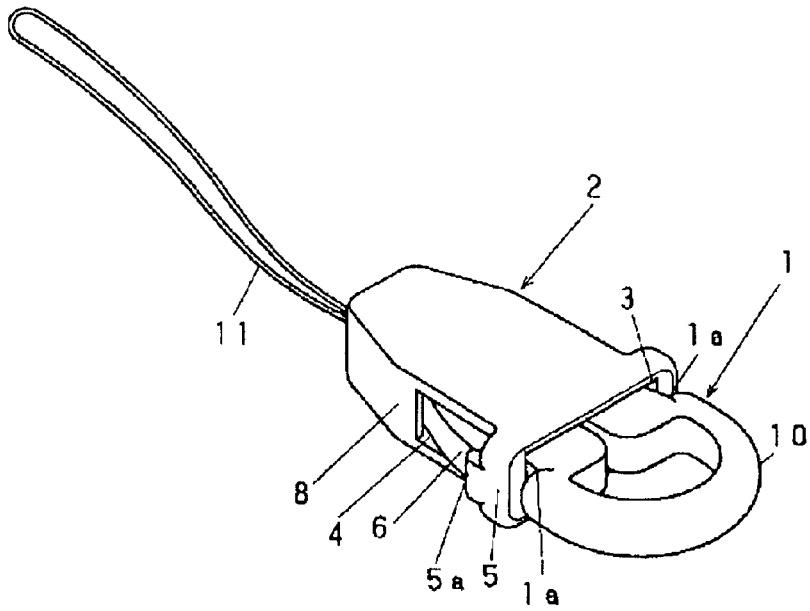
FIG. 1 is an oblique view of the first embodiment of the strap buckle of the present invention.

The first invention is a strap buckle such that it is a strap buckle composed of male part 1 and female part 2. The male part 1 is such that a push-through ring 10 to which is attached a belt, cord, etc., is formed and insertion part 7 is formed so as to protrude from the aforementioned push-through ring 10 toward the exterior. The aforementioned insertion part 7 is bifurcated longitudinally by slit 9 that extends from the interior of push-through ring 10 to the exterior of aforementioned push-through ring 10, and the two catching pieces 6, 6 are formed by folding back and outwardly from the ends of insertion parts 7, 7. The female part 2, a roughly rectangular cylinder, is such that insertion hole 3 into which is inserted male part 1 is provided at one end in the longitudinal direction and loop cord mounting hole 12 is provided at the other end. Also, its side 8 is shaped so as to slope inwardly from aforementioned insertion hole 3, in the direction of insertion of male part 1. Catch-receiving side hole 4 is provided in the aforementioned side 8; and catch-receiving projection 5 that catches catching piece 6 of male part 1 is provided at both ends on the insertion hole 3 side of catch-receiving side hole 4.

Also, the second invention is a strap buckle composed of male part 1 and female part 2. Male part 1 is such that push-through ring 10 to which is attached a belt, cord, etc., is formed and insertion part 7 is formed so as to protrude from aforementioned push-through ring 10 toward the exterior; aforementioned insertion part 7 is bifurcated longitudinally by slit 9 that extends from the interior of push-through ring 10 to the exterior of aforementioned push-through ring 10. The two catching pieces 6, 6 are formed by folding back and outwardly from the ends of insertion parts 7, 7. Female part 2, a roughly rectangular cylinder, is such that insertion hole 3 into which is inserted male part 1 is provided at one end in the longitudinal direction and a loop cord mounting hole 12 is provided at the other end; also, its side 8 is shaped so as to slope inwardly from aforementioned insertion hole 3, in the direction of insertion of male part 1. Catch-receiving side hole 4 is provided in aforementioned side 8; and catch-receiving projection 5 that catches a catching piece 6 of male part 1 is provided at both ends, on the insertion hole 3 side of catch-receiving side hole 4. Aforementioned slit 9 is in the almost-closed state while the male part 1 is inserted into the female part 2.

The modes for carrying out the present invention will be explained next, based on the structures of the embodiments.

The basic structure of the strap buckle of the present invention consists of a male part 1 and a female part 2, and both male part 1 and female part 2 are molded by using an elastic synthetic resin. In male part 1, push-through ring 10 to which a belt, cord, etc., is attached is formed. Insertion part 7 is formed from aforementioned push-through ring 10 toward the exterior, and the two catching pieces 6 are formed by folding back and to both sides from the ends of the said insertion parts 7. According to the embodiments, this insertion part 7 is structured so as to be bifurcated longitudinally by slit 9 that extends longitudinally from the interior to the exterior of push-through ring 10. Materials, etc., that have been preprocessed into a ring shape and that have an insertion hole with a closed periphery (e.g., a belt, cord, ring) are mounted on push-through ring 10 via this slit 9. Also, to facilitate the mounting of the belt, etc., it is desirable to provide this slit 9 in such a manner that it opens gradually outward. In some embodiments, this slit 9 is formed so that it almost closes after male part 1 is inserted into female part 2. Push-through ring 10 is circular or semicircular. Shoulder 1*a* on both sides, near the protuberance of insertion part 7, has a width almost equal to the inner-edge dimension of insertion hole 3 of female part 2, so that when male part 1 is inserted and catching piece 6 abuts catch-receiving projection 5, it acts to prevent play in the coupled state.

Female part 2 is shaped roughly like a rectangular cylinder composed of upper and lower walls and sides 8. Insertion hole 3, in which is inserted male part 1, is provided at one end in its longitudinal direction, and loop cord mounting hole 12 is provided at the other end thereof. Also, its side 8 is formed so as to slope inwardly from aforementioned insertion hole 3, in the direction of insertion of male part 1. Catch-receiving side hole 4 is provided in aforementioned side 8; and catch-receiving projection 5 that catches catching piece 6 of male part 1 is provided on the outer surface of the end, on the insertion hole 3 side of catch-receiving side hole 4. Side 8 is shaped so as to slope inwardly from insertion hole 3 in the direction of the insertion of male part 1. There is no release lever 13 as in conventional cases, so the product is miniaturized and production is simplified. By adopting a vertically divided mold, it is simplified and it also is easy obtain many, which reduces the production cost per product. Furthermore, in some embodiments, rib 2*a* is formed along the direction of insertion in one or both inner surfaces of the aforementioned upper and lower walls, thereby smothering the insertion of male part 1 and stabilizing the coupled state.

Regarding the coupling of male part 1 and female part 2, as the insertion part 7 of male part 1 is inserted into insertion hole 3 of female part 2, the two catch pieces 6 formed rearward at the sides of male part 1 flex inwardly as they enter. Catch pieces 6 return to their original dimensions at the position of catch-receiving side holes 4 provided on sides 8 of female part 2; and their ends both catch when they abut the catch-receiving projections 5 formed in the outer ends, on the insertion hole 3 sides of catch-receiving side hole 4. At this time, male part 1 is securely caught in a fixed position, so small protuberance 5*a* that protrudes so as to embrace the outer surface of the end of abutting catch piece 6 may be formed on the outside of catch-receiving projection 5. The buckle is released by pulling out male part 1 while using the fingertips to pinch, from both sides, the catch pieces 6 of coupled male part 1.

Figure 2:
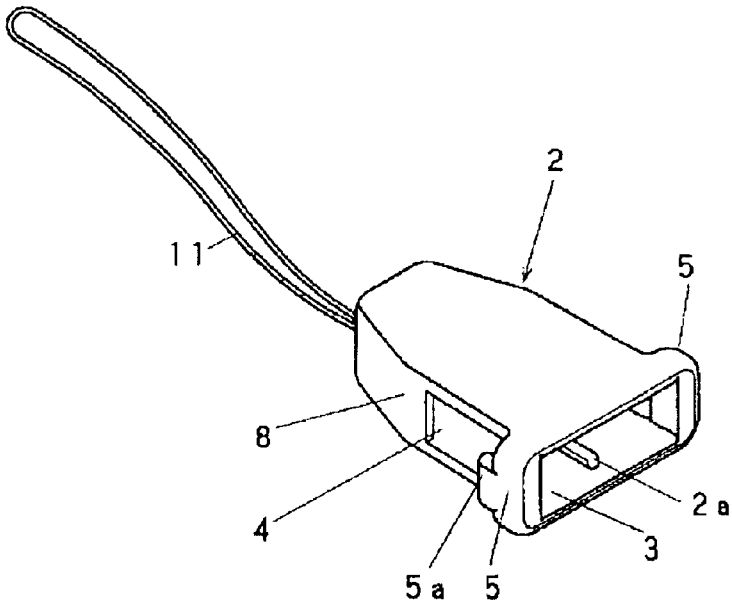
FIG. 2 is an oblique view of the female part thereof.
Figure 3:
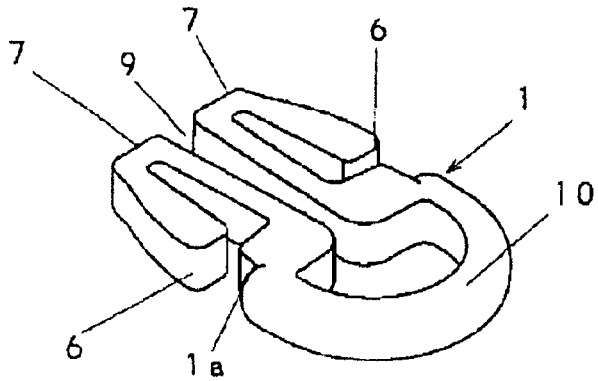
FIG. 3 is an oblique view of the male part thereof.
Figure 4:
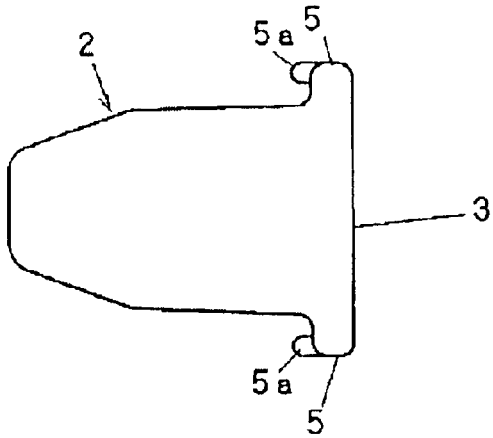
FIG. 4 is the top view of the female part thereof.
Figure 5:
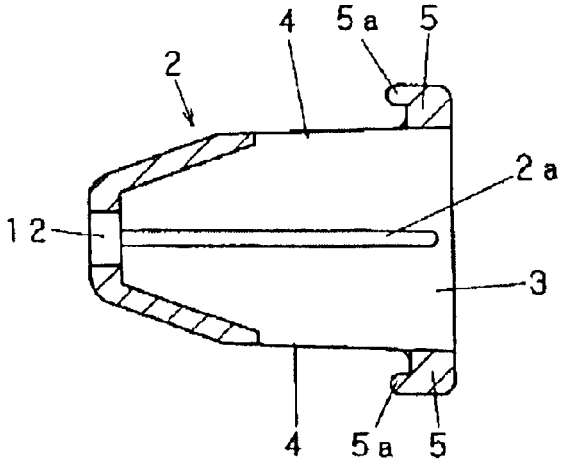
FIG. 5 is a cross-sectional view of the female part thereof.
Figure 6:
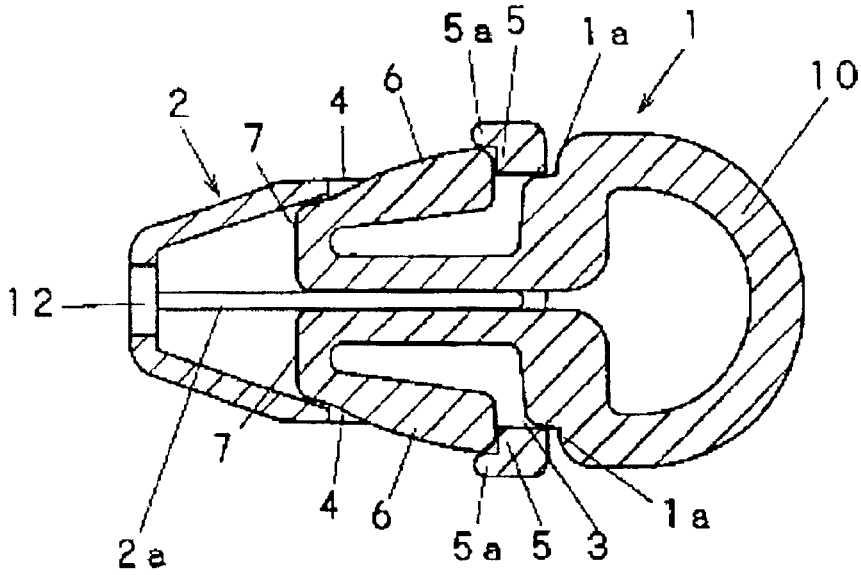
FIG. 6 is a cross-sectional view showing the state in which the male part and the female part are coupled.

FIG. 1 is an oblique view of the overall strap buckle of the first embodiment of the present invention. FIG. 2 is an oblique view of the female part. FIG. 3 is an oblique view of the male part. FIG. 4 is the top view of the female part. FIG. 5 is a cross-sectional view of the female part. FIG. 6 is a cross-sectional view showing the coupled state.

In the aforementioned drawings, 1 indicates the buckle's male part, and 2 indicates the buckle's female part. Male part 1 and female part 2 are molded by using an elastic synthetic resin.

Regarding male part 1 shown in FIG. 3, push-through ring 10 to which is attached a belt, cord, etc., is formed, and insertion part 7 is formed so as to protrude outwardly from push-through ring 10. Two catch pieces 6 are formed in the longitudinal direction by folding the ends of insertion parts 7 back and to both sides. Shoulder 1*a* near the protruding part of insertion part 7 of push-through ring 10 is formed with a width almost equal to the dimension of the inner edge of insertion hole 3 of female part 2. When male part 1 is inserted and cat piece 6 abuts catch-receiving projection 5, it acts to prevent play in the coupled state. Furthermore, in this embodiment is formed slit 9 that extends lengthwise from the inside to the outside of push-through ring 10 and that gradually expands outwardly. This slit 9 enables the attachment of a material, etc., with a connection hole (e.g., a belt, cord, ring) that has been preprocessed into a ring shape. Also, this slit 9 is designed to further simplify the work involved in attaching a belt, etc., because it is provided so as to gradually expand outwardly.

FIGS. 2, 4, and 5 show the structure of female part 2, which is shaped approximately like a rectangular cylinder composed of upper and lower walls and sides 8. Insertion hole 3, into which male part 1 is inserted, is provided at one end in its longitudinal direction, and loop cord mounting hole 12 is provided at the other end. Also, its side 8 is formed so as to slope inwardly from aforementioned insertion hole 3 in the direction of the insertion of male part 1. The slope enables the creation of a mold by simply splitting vertically from insertion hole 3 in the direction of insertion. Also, catch-receiving side hole 4 is provided in side 8, and catch-receiving projection 5 that catches catch piece 6 of male part 1 is provided on the outer surface of the end, on the insertion hole 3 side of catch-receiving side hole 4. Also, in the present embodiment, small protuberances 5*a* are formed so as to embrace the ends of catch pieces 6 after they abut the outside of catch-receiving projections 5. Furthermore, ribs 2*a* are formed in the insertion direction, along the inner surfaces of the aforementioned top and bottom walls, and they are designed to smoothen the insertion of male part 1 and to ensure a stable coupled state. Regarding the installation of loop cord 11, the two ends of folded loop cord 11 are overlapped and inserted into female part 2 via female part loop cord mounting hole 12 and then knotted to prevent their detachment.

Figure 7:
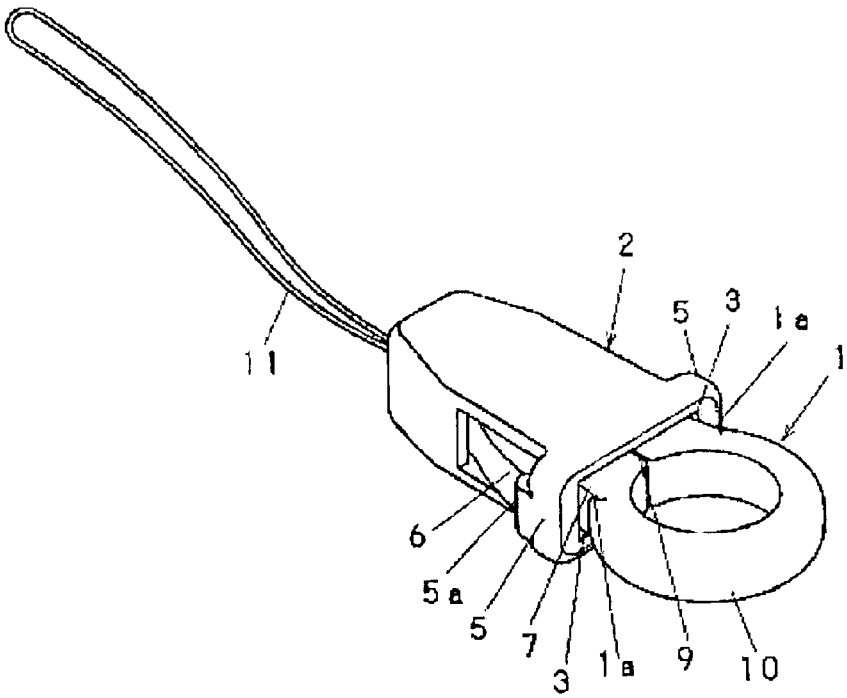
FIG. 7 is an oblique view of the second embodiment.
Figure 8:
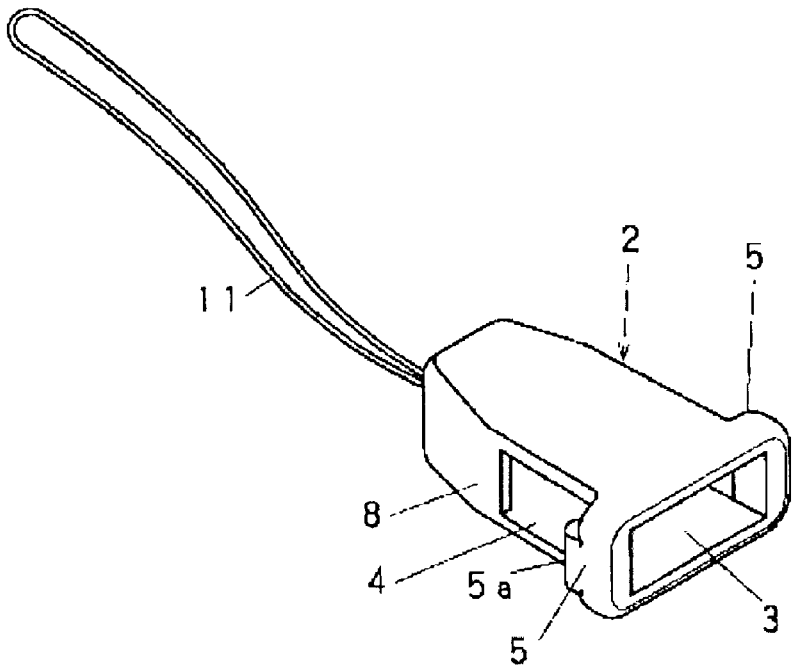
FIG. 8 is an oblique view of the female part thereof.
Figure 9:
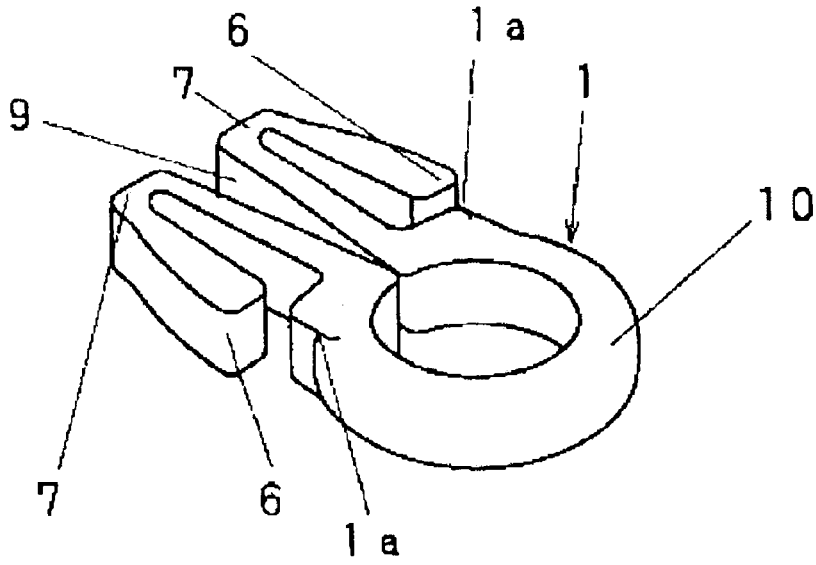
FIG. 9 is an oblique view of the male part thereof.
Figure 10:
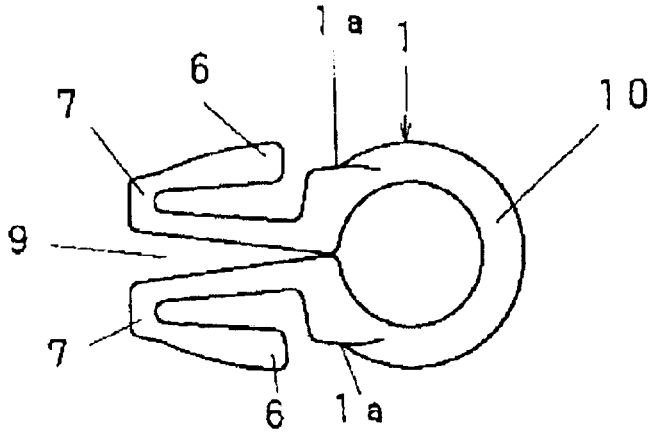
FIG. 10 is the top view of the male part thereof.
Figure 11:
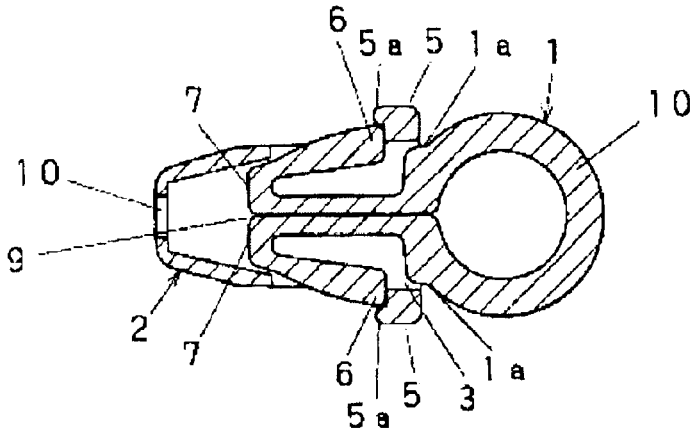
FIG. 11 is a cross-sectional view showing the state in which the male part and the female part are coupled.
Figure 12:
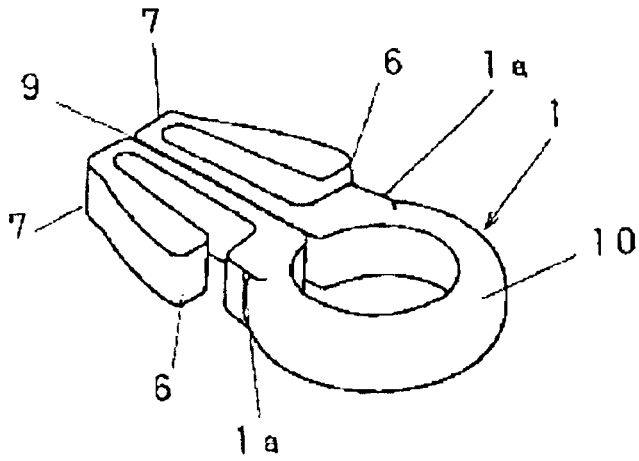
FIG. 12 is an oblique view of the male part in the aforementioned coupled state.
Figure 13:
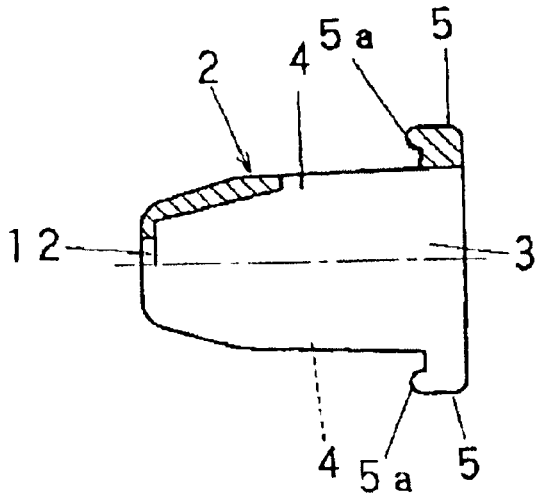
FIG. 13 is a top, half-cross-sectional view of the female part thereof.

The structure of the second embodiment will be explained next. FIG. 7 is an oblique view of the overall strap buckle of the second embodiment. FIG. 8 is an oblique view of the female part. FIG. 9 is an oblique view of the male part. FIG. 10 is the top view of the male part. FIG. 11 is a cross-sectional view showing the coupled state. FIG. 12 is an oblique view of the male part, showing the orientation of the coupled state. FIG. 13 is a top, half-cross-sectional view of the female part.

In the aforementioned drawings, 1 indicates the buckle's male part, and 2 indicates the buckle's female part. Male part 1 and female part 2 are molded by using an elastic synthetic resin.

In this second embodiment, the basic structure and function approximate those of the aforementioned first embodiment, so a detailed explanation is omitted. The structure differs, however, in that push-through ring 10 is circular. This has the advantage of preventing the overlapping and tangling of belts, etc., because the positional relationships of individual belts relative to push-through ring 10 can be determined freely when attaching multiple belts, etc., to push-through ring 10. In the second embodiment, rib 2*a* can be omitted as shown in FIGS. 11 and 12, so when male part 1 and female part 2 are coupled, the shape is such that slit 9 of male part 1 closes almost completely. Such structure has the feature of preventing such trouble as the catching of a cord in slit 9 when the cord is attached.

Figure 14:
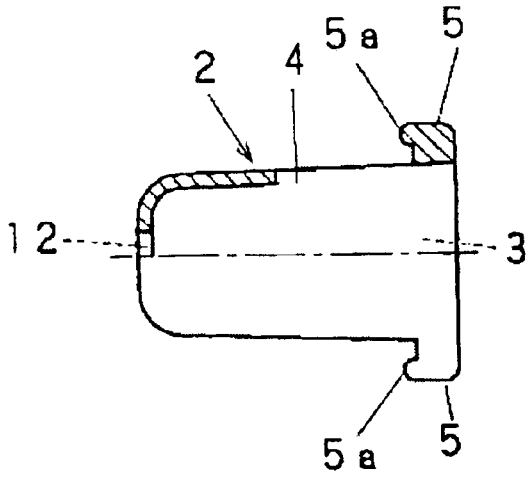
FIG. 14 is a top, half-cross-sectional view of the first modified example.
Figure 15:
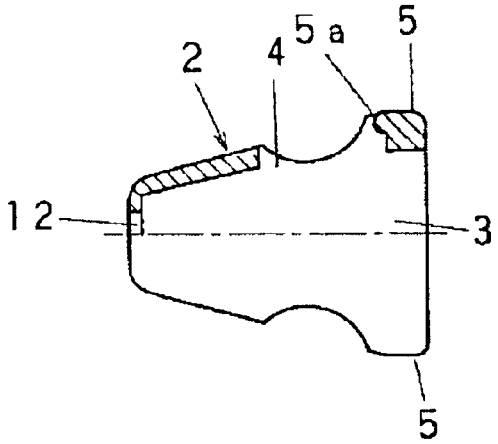
FIG. 15 is a top, half-cross-sectional view of the second modified example.
Figure 16:
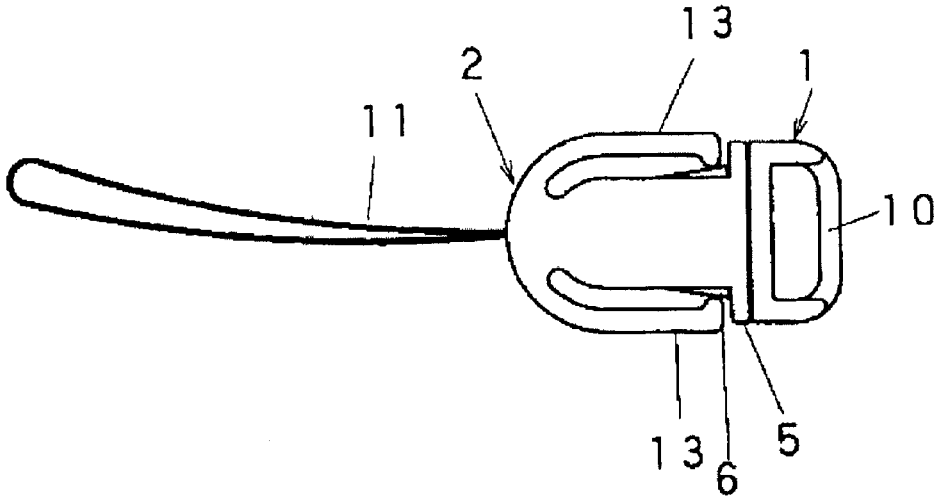
FIG. 16 is an illustration of a conventional strap buckle.

In FIGS. 14 and 15, both the first modified example and the second modified example of female part 2 of the second embodiment are shown as a top, half-cross-sectional view. Both of these had their external shape modified because of design requirements, and the functionality is identical to that of female part 2 of the other embodiment.

Embodiments considered representative of the present invention were explained previously, but the present invention is not necessarily limited only to the structures of these embodiments. Therefore, it can be implemented by modifying it as desired within the range in which: materials with equivalent properties are modified and used, the aforementioned structural requirements described in the present invention with respect to structure and shape are met, the purposes described in the present invention are achieved, and it has the following effects.

As explained previously, the strap buckle of the present invention has the following effects. By forming the sides of the female part so that they slope inwardly from the aforementioned insertion holes, in the direction of insertion of the male part, and by eliminating the release lever found in conventional examples, the resulting simple structure only requires that the mold be split vertically. This enables the production of multiple molds, so molds can be supplied inexpensively. Also, the structure of the female part of the buckle can be simplified further by eliminating the release lever, which also has the effect of enabling the supply of buckles that are smaller and cheaper than conventional products.

The provision of a slit in the push-through ring of the male part has the following remarkable effect that could not be anticipated in conventional products: The productivity is improved considerably because it is possible to easily attach a belt, cord, part, etc., with a preformed loop at its end.

Explanation of the Symbols

1 Male part
2 Female part
3 Insertion hole
4 Catch-receiving side hole
5 Catch-receiving projection
6 Catching piece
7 Insertion part
8 Side
9 Slit
10 Push-through ring
11 Loop cord
12 Male part loop cord mounting hole
13 Release lever

What I claim is:

1. A strap buckle, comprising:

a male part including a push-through ring and an insertion section, said insertion section being bifurcated longitudinally by a slit into two insertion parts and including a catch arranged on each of said insertion parts; and a female part including an insertion hole receivable of said insertion section of said male part, said female part having opposed longitudinal sides, said female part including a catch-receiving hole on each of said longitudinal sides arranged to receive a respective one of said catches on said male part when said insertion section of said male part is inserted into said insertion hole of said female part, said female part further including a projection arranged on each longitudinal side adjacent a respective one of said catch-receiving holes to engage the respective one of said catches on said male part when said insertion section of said male part is inserted into said insertion hole of said female part, said female part further comprising a protuberance formed on each of said projections and projecting in a direction of insertion of said insertion section into said insertion hole.

* * * * *